US007298094B2

(12) United States Patent
Yui

(10) Patent No.: US 7,298,094 B2
(45) Date of Patent: Nov. 20, 2007

(54) IMAGE DISPLAY APPARATUS

(75) Inventor: Hideaki Yui, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/645,055

(22) Filed: Dec. 26, 2006

(65) Prior Publication Data

US 2007/0145903 A1 Jun. 28, 2007

(30) Foreign Application Priority Data

Dec. 28, 2005 (JP) ..... 2005-377894
Dec. 6, 2006 (JP) ..... 2006-329286

(51) Int. Cl.
*H05B 37/00* (2006.01)
*G09G 3/22* (2006.01)

(52) U.S. Cl. ..... 315/161; 345/75.2

(58) Field of Classification Search ..... 315/161; 345/66, 74.1, 75.2, 77, 78
See application file for complete search history.

(56) References Cited

U.S. PATENT DOCUMENTS 6,307,327 B1 10/2001 Xie et al. ..... 315/169.4
6,390,873 B1 * 5/2002 Banno et al. ..... 445/6
6,743,066 B1 * 6/2004 Oguchi et al. ..... 445/6
6,870,522 B2 * 3/2005 Sagano et al. ..... 345/75.2
7,046,219 B2 * 5/2006 Kanai et al. ..... 345/75.2
2005/0285543 A1 * 12/2005 Yui et al. ..... 315/169.4
2005/0286062 A1 * 12/2005 Yui ..... 358/1.9
2006/0061593 A1 * 3/2006 Miura et al. ..... 345/612
2006/0125731 A1 * 6/2006 Yui ..... 345/75.2

FOREIGN PATENT DOCUMENTS

JP 2005-31636 2/2005

* cited by examiner

*Primary Examiner*—Thuy Vinh Tran
(74) *Attorney, Agent, or Firm*—Fitzpatrick, Cella, Harper & Scinto

(57) ABSTRACT

To provide an image display apparatus, including first to N-th electron-emitting devices; a spacer; a driving circuit for correcting each of the first to N-th driving signals for driving the first to N-th electron-emitting devices and outputting it; first to N-th light emission areas; in which the driving circuit has a correction circuit; and the correction circuit has a first circuit of calculating a correction value for correcting the driving signal; a second circuit of calculating a representative value by using a plurality of correction values for correcting the driving signal for driving each electron-emitting device of a group consisted of near M pieces of electron-emitting devices including first and second electron-emitting devices; a storage unit for storing the representative value; and a third circuit for correcting a driving signal for driving each electron-emitting device of the group by using the representative value.

9 Claims, 11 Drawing Sheets

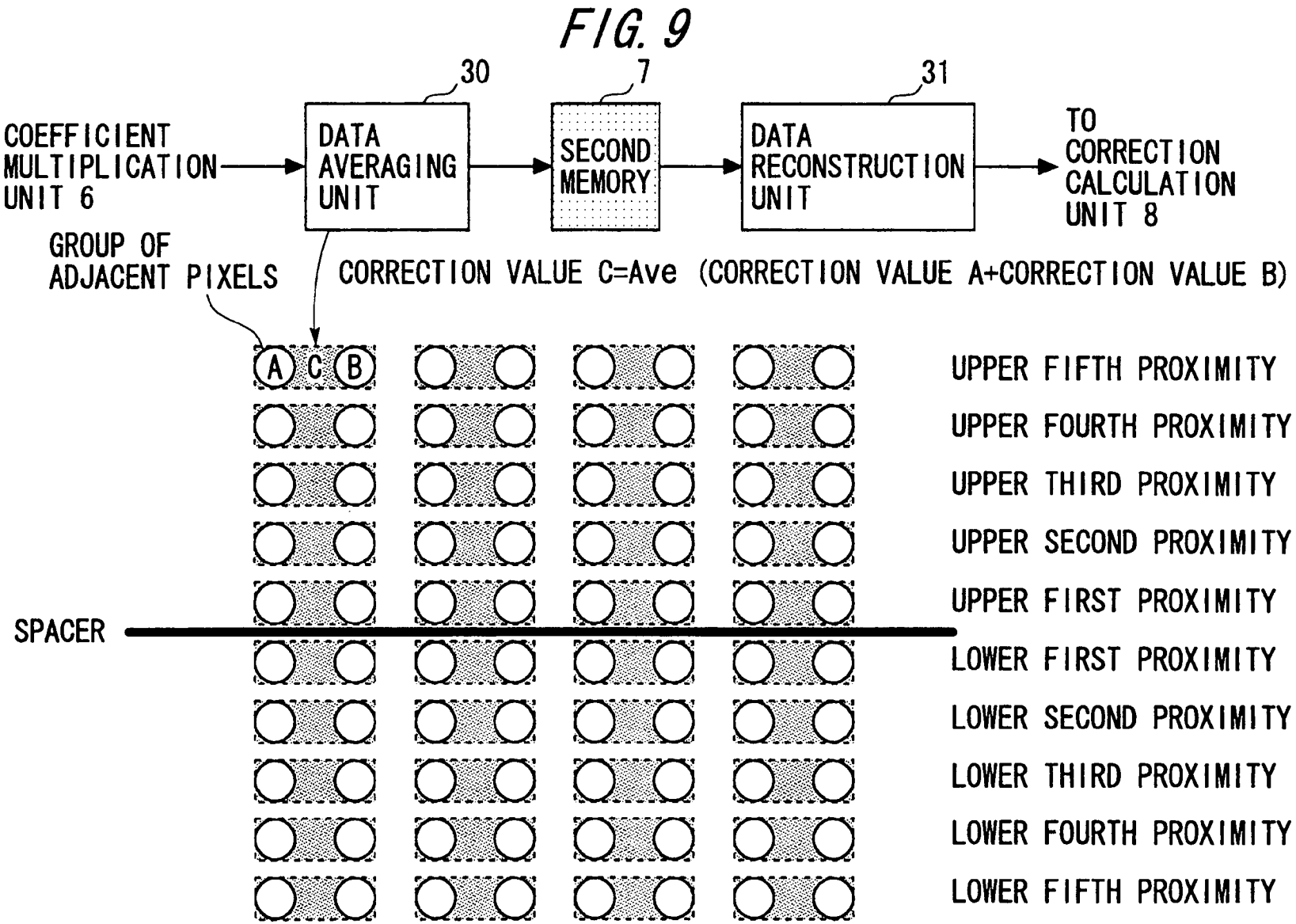
FIG. 9
COEFFICIENT MULTIPLICATION UNIT 6
30
DATA AVERAGING UNIT
7
SECOND MEMORY
31
DATA RECONSTRUCTION UNIT
TO CORRECTION CALCULATION UNIT 8
GROUP OF ADJACENT PIXELS
A
C
B
CORRECTION VALUE C=Ave (CORRECTION VALUE A+CORRECTION VALUE B)
UPPER FIFTH PROXIMITY
UPPER FOURTH PROXIMITY
UPPER THIRD PROXIMITY
UPPER SECOND PROXIMITY
UPPER FIRST PROXIMITY
LOWER FIRST PROXIMITY
LOWER SECOND PROXIMITY
LOWER THIRD PROXIMITY
LOWER FOURTH PROXIMITY
LOWER FIFTH PROXIMITY
SPACER

IMAGE DISPLAY APPARATUS

BACKGROUND OF THE INVENTION

1. Field of the Invention

The present invention relates to an image display apparatus.

2. Description of the Related Art

In a U.S. Pat. No. 6,307,327, as a method to control a visibility of a spacer in an electron field emission display, a pixel data correction method to correct pixel data to be transmitted to a first area depending on a intensity of a light to be generated by a plurality of pixels of a first area in the vicinity of a spacer in order to prevent the spacer from being viewable to a viewer by defining a region as the first region in the vicinity of the spacer and a second region not in the vicinity of the spacer is disclosed.

In a Japanese Patent Application Publication Laid-Open (JP-A) No. 2005-31636, it is disclosed that a correction circuit stores an original image signal in a first memory as it is, calculates a correction amount on the basis of the output of the first memory, and calculates correction for the original image signal which is read from the first memory as same as the calculated correction amount.

SUMMARY OF THE INVENTION

In order to correct a brightness of an interested pixel, the structure to calculate a correction value with reference to the data of the near pixel requires a large capacity of memory.

An object of the present application is to provide an image display apparatus for executing correction with high precision while reducing a memory amount or preventing the required memory amount.

To achieve that object, the present invention provides an image display apparatus, comprises: first to N-th electron-emitting devices (N is an integer number of 5 or more); a spacer; a driving circuit for correcting each of first to N-th driving signals for driving the first to N-th electron-emitting devices and outputting the corrected driving signals; and first to N-th light emission areas, wherein a K-th light emission area (K is an integer number of 1 or more to N or less) mainly emits light when a K-th electron-emitting device is driven; a distance between the fifth electron-emitting device and the spacer is longer than a distance between the first electron-emitting device and the spacer and is longer than a distance between the second electron-emitting device and the spacer; the first electron-emitting device and the third electron-emitting device are located at the opposite side with respect to the spacer; a distance between the first electron-emitting device and the third electron-emitting device is equal to or less than a distance between the light emission area farthest from the first light emission area among the light emission areas emitting light when the first electron-emitting device is driven and the first light emission area; the second electron-emitting device and the fourth electron-emitting device are located at an opposite side with respect to the spacer; a distance between the second electron-emitting device and the fourth electron-emitting device is equal to or less than a distance between the light emission area farthest from the second light emission area among the light emission areas emitting light when the second electron-emitting device is driven and the second light emission area; and the driving circuit has a correction circuit, wherein the correction circuit has: a first circuit for calculating a correction value for correcting the driving signal; a second circuit for calculating a representative value by using a plurality of correction values for correcting the driving signal for driving each electron-emitting device of a group made of near M pieces of electron-emitting devices (M is an integer number of 2 or more to N or less) including first and second electron-emitting devices; a storage unit for storing the representative value; and a third circuit for correcting a driving signal for driving each electron-emitting device of the group by using the representative value, wherein a correction value for correcting the first driving signal is a correction value, which depends on the third driving signal and can compensate a difference between a brightness of the fifth light emission area and a brightness of the first light emission area when the N pieces of electron-emitting devices are driven by the same driving signal; and a correction value for correcting a second driving signal is a correction value, which depends on a fourth driving signal and can compensate a difference between a brightness of the fifth light emission area and a brightness of the second light emission area when the N pieces of electron-emitting devices are driven by the same driving signal.

In addition, the present invention provides an image display apparatus, comprises: first to N-th electron-emitting devices (N is an integer number of 4 or more); a driving circuit for correcting each of the first to N-th driving signals for driving the first to N-th electron-emitting devices and outputting it; and first to N-th light emission areas, wherein a K-th light emission area (K is an integer number of 1 or more to N or less) mainly emits light when a K-th electron-emitting device is driven; a distance between the first electron-emitting device and the third electron-emitting device is equal to or less than a distance between the light emission area farthest from the first light emission area among the light emission areas emitting light when the first electron-emitting device is driven and the first light emission area; a distance between the second electron-emitting device and the fourth electron-emitting device is equal to or equal to or less than a distance between the light emission area farthest from the second light emission area among the light emission areas emitting light when the second electron-emitting device is driven and the second light emission area; and the driving circuit has a correction circuit, wherein the correction circuit has: a first circuit for calculating a correction value for correcting the driving signal; a second circuit for calculating a representative value by using a plurality of correction values for correcting the driving signal for driving each electron-emitting device of a group consisted of near M pieces of electron-emitting devices (M is an integer number of 2 or more and N or less) including first and second electron-emitting devices; a storage unit for storing the representative value; and a third circuit for correcting a driving signal for driving each electron-emitting device of the group by using the representative value, wherein a correction value for correcting the first driving signal is a correction value, which can compensate a brightness of the first light emission area generated when the first electron-emitting device is not driven but the third electron-emitting device is driven; and a correction value for correcting the second driving signal is a correction value, which can compensate a brightness of the second light emission area generated when the second electron-emitting device is not driven but the fourth electron-emitting device is driven.

Here, "a light emission area which mainly emits light when a K-th electron-emitting device is driven" means an area of a luminous body (a fluorescence body) emitting a light when the electron emitted from the K-th electron-emitting device is directly irradiated.

BRIEF DESCRIPTION OF THE DRAWINGS

FIG. 9 is an explanatory view of a halation correction system to average a correction value between the adjacent pixels;

DESCRIPTION OF THE EMBODIMENTS

First Embodiment

A first embodiment of the present invention will be described below.

An image display apparatus according to the present embodiment may include various kinds of display apparatuses such as a display apparatus using a surface-conduction electron-emitting device and an FED or the like. The present invention can be applied to various display apparatuses having crosstalk generated because the present invention can appropriately reduce adverse impacts on a vision of the crosstalk. For example, for an electron beam display such as a display apparatus using a surface-conduction electron-emitting device and an FED or the like, it is preferable that the present embodiment is applied because there is a possibility that a halation light emission is generated at a peripheral pixel due to self-luminance spot and brightness. Thus, particularly, the present embodiment is preferably applied in the image display apparatus in which the crosstalk may be generated between the near elements. Hereinafter, the structure of the display apparatus using the surface-conduction electron-emitting device as the image display apparatus will be described as a particularly preferable embodiment.

At first, the structure of the image display apparatus according to the present embodiment will be described with reference to FIG. 2.

<1. Display Panel 20>

A display panel 20 is provided with a multi electron source made by arranging many electron sources (for example, a cold cathode element) on a substrate and an image-forming member (for example, a fluorescent body) to form an image due to irradiation of an electron so as to be opposed each other in a thin-type vacuum container. The display panel 20 has N pieces of electron-emitting devices wired in a simple matrix by a row direction wired electrode and a column direction wired electrode, and an electron is emitted from an element which is selected by a column/row electrode bias. Then, light emission is obtained by accelerating an electron with a high-speed voltage and impacting this against the fluorescent substance.

Figure 11:
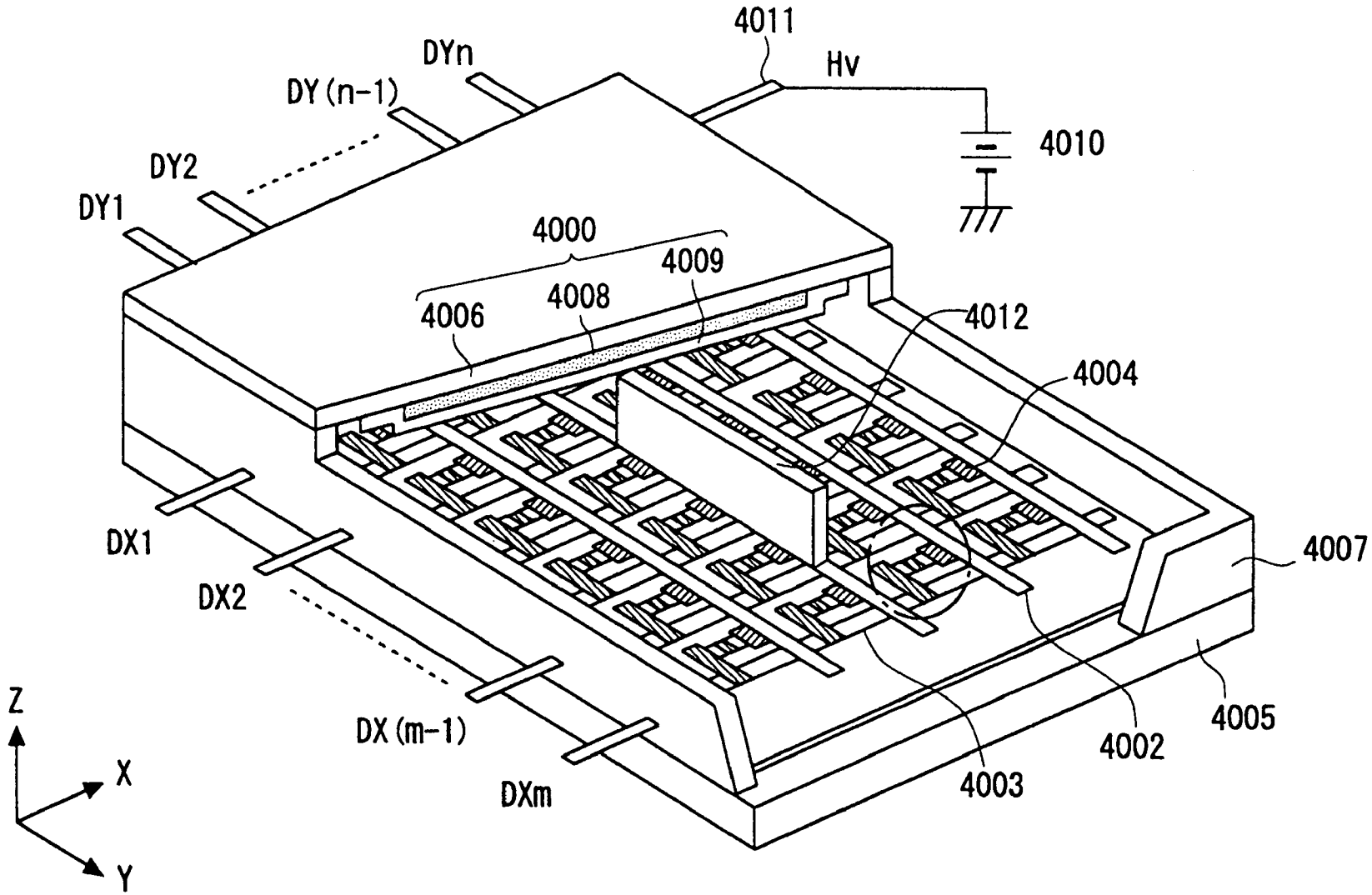
FIG. 11 is a view showing a constitutional example of a display panel 20.

FIG. 11 is a view showing a constitutional example of a display panel 20. As an electron-emitting device shown in FIG. 11, various electron-emitting devices can be used, and various electron-emitting devices may include, for example, a Spindt-type electron-emitting device combining an emitter cone and a gate electrode and the electron-emitting device using a carbon fiber such as a carbon nano tube and a graphite nano fiber. The structure that a plurality of electron-emitting devices 4004 are matrix-connected through a plurality of scan signal applying lines 4002 and a plurality of modulation signal applying lines 4003 is employed. Scan signals to be outputted from a row selection control unit 17 are applied to the plurality of scan signal applying lines 4002 in series. In addition, to a plurality of modulation signal applying lines 4003, driving signals to be outputted from a PWM pulse control unit 14 are applied, respectively. The electron-emitting device, and the scan signal applying lines and modulation signal applying lines, to which the electron-emitting device is matrix-connected, are disposed on a glass plate 4005.

In addition, according to the present embodiment, as a luminous body, a fluorescence body 4008 is used. The fluorescence body 4008 is disposed on a glass plate 4006 to be a substrate. On the glass plate 4006, a metal back 4009, which is an accelerating potential for accelerating an electron emitted from the electron discharge element, is provided. To the metal back 4009, an accelerating potential is supplied from a power source 4010 through a high voltage terminal 4011. A glass frame 4007 to be an outer frame is positioned between the glass plate 4005 and the glass plate 4006, and a space between the glass plate 4005 and the glass frame 4007 and a space between the glass plate 4006 and the glass frame 4007 are sealed to be air-tight, respectively, so as to form an airtight container by the glass plate 4005, the glass plate 4006, and the glass frame 4007. The interior of the airtight container is kept vacuum. In this airtight container, a platy spacer 4012 is arranged and the spacer 4012 prevents the airtight container from being crashed by a difference of a pressure between the interior of the airtight container and the exterior thereof. Further, a columnar spacer also can be used.

Next, the operation since a video signal is inputted in the display panel 20 till the video signal is displayed using the surface-conduction electron-emitting device will be described.

<2. Signal Processing Unit 10>

Figure 2:
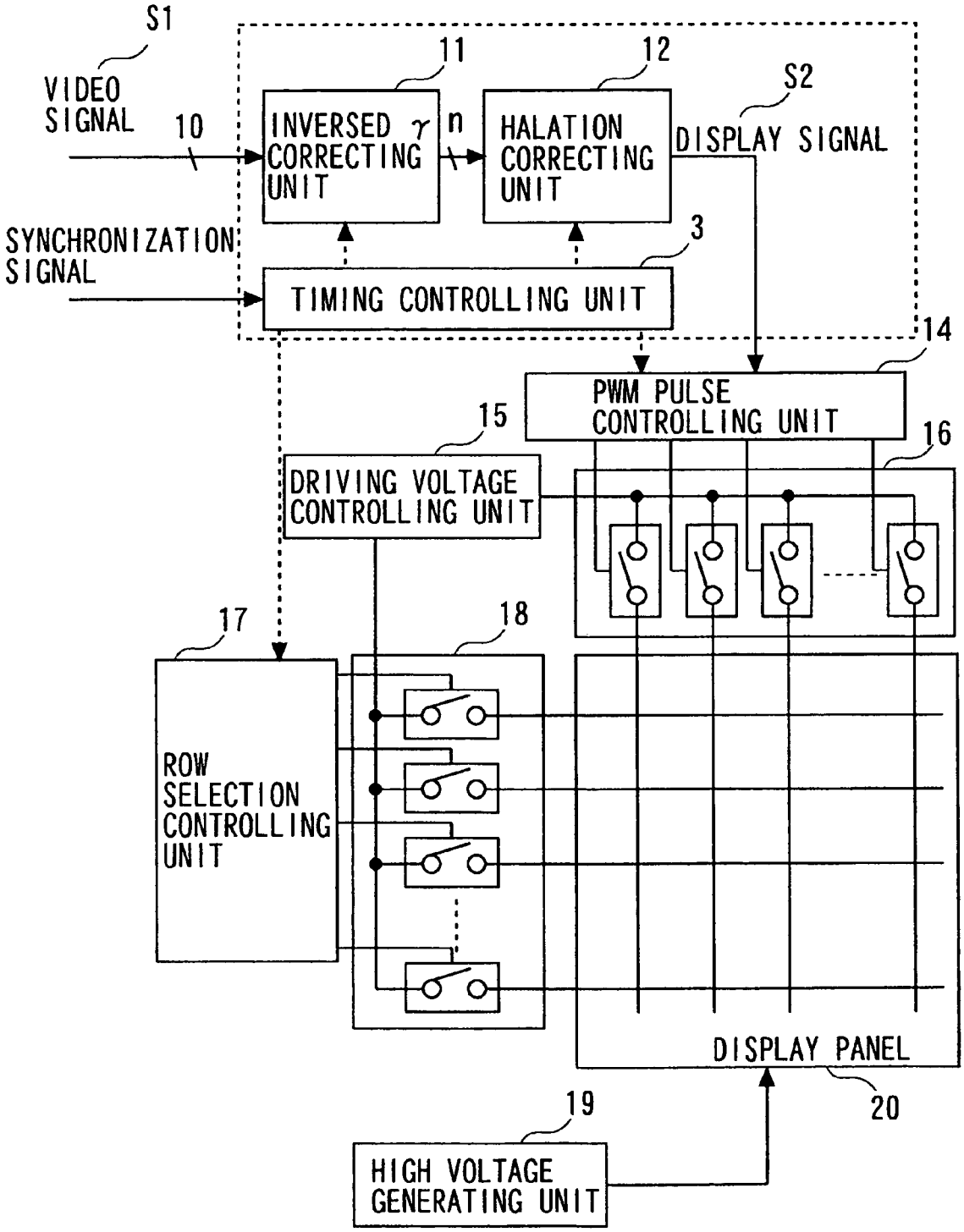
FIG. 2 is a block diagram of a display apparatus using a surface-conduction electron-emitting device according to the present invention.

A signal processing unit 10 shown in FIG. 2 may provide signal processing preferable for display to an input video signal S1, and may output a display signal S2 (equivalent to "a driving signal" of the present invention). Further, in FIG. 2, the description about the function of the signal processing unit 10 is given with respect to a minimum necessary functional block for explanation of the present embodiment.

<2.1 inversed γ correcting unit 11>

Generally, the input video signal S1 is transmitted or recorded being provided with a nonlinear conversion (γ=0.45) referred to as a gamma conversion in accordance with an input signal—light emitting property (γ=2.2) of a CRT display. An inversed γ correcting unit 11 may provide an inversed gamma conversion such as 2.2th power to the input signal in the case of displaying the input video signal S1 on an image display apparatus having a linear input—light emitting property such as a display apparatus using the surface-conduction electron-emitting device, the FED, and the PDP.

In addition, the input video signal S1 to the inversed γ correcting unit 11 is inputted with each color of 8 to 10 bits in many cases. However, in order to avoid underexposure of a low gradation part due to the nonlinear gamma conversion or the like in the inversed γ correcting unit 11, generally, the conversion to increase the data amount to 10 to 16 bits in accordance with the display capability of the display apparatus is done in many cases.

The inversed γ correcting unit 11 may convert the data into a system that the luminance and the data of the display panel are linear and may output this data to a halation correcting unit 12.

<2.2 Halation Correcting Unit 12>

The halation correcting unit 12 may output a display signal S2 for displaying a preferable image on the display panel 20. Further, the halation correcting unit 12 will be described in detail below.

<2.3 Timing Controlling Unit 13>

A timing controlling unit 13 may generate various timing signals for the operation of each block on the basis of a synchronization signal given together with the input video signal S1 and may output them.

<3. PWM Pulse Controlling Unit 14>

A PWM pulse controlling unit 14 may convert a display signal S2 into a driving signal adapted to a display panel 20 (according to the present embodiment, a pulse width modulation signal (PWM)) for each horizontal one cycle (a row selection period).

<4. Driving Voltage Controlling Unit 15>

A driving voltage controlling unit 15 may control a voltage for driving an element arranged on the display panel 20.

<5. Column Wire Switching Unit 16>

A column wire switching unit 16 is configured by a switching means such as a transistor, and the output from the driving voltage controlling unit 15 is applied to a panel row electrode for each horizontal one cycle (row selection period) for a period of a PWM pulse outputted from the PWM pulse controlling unit 14.

<6. Row Selection Controlling Unit 17>

A row selection controlling unit 17 may generate a row selection pulse to drive the element on the display panel 20.

<7. Row Wire Switching Unit 18>

A row wire switching unit 18 is configured by a switching means such as a transistor, and the row wire switching unit 18 may output the output from the driving voltage controlling unit 15 in accordance with the row selection pulse to be outputted from the row selection controlling unit 17 to the display panel 20.

<8. High Voltage Generating Unit 19>

A high voltage generating unit 19 may generate an accelerating voltage for accelerating an electron emitted from the electron-emitting device arranged on the display panel 20 so as to impact it against the fluorescent body. As described above, the display panel 20 is driven and the image is displayed.

According to the present embodiment, a driving circuit according to the present invention is configured by the signal processing unit 10, the PWM pulse controlling unit 14, the driving voltage controlling unit 15, the column wire switching unit 16, the row selection controlling unit 17, and the row wire switching unit 18. In addition, the correction circuit of the present invention is configured by the halation correcting unit 12.

<<2.2 Halation Correcting Unit 12>>

Figure 1:
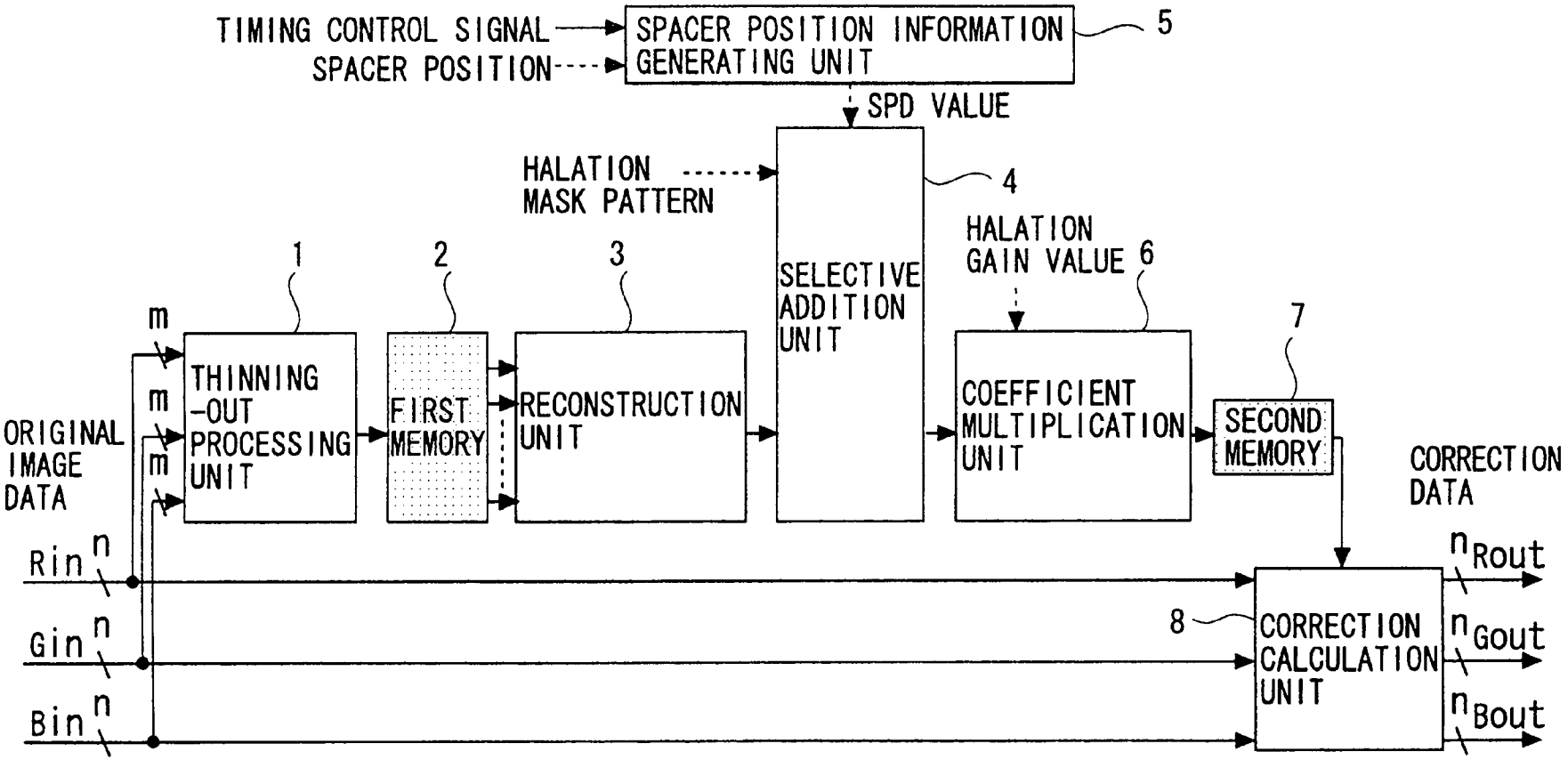
FIG. 1 is a block diagram of a halation correction unit according to the present invention.

Next, a halation correcting unit 12 will be described with reference to FIG. 1.

Here, the halation on the display panel 20 will be described before explaining FIG. 1.

Figure 3A:
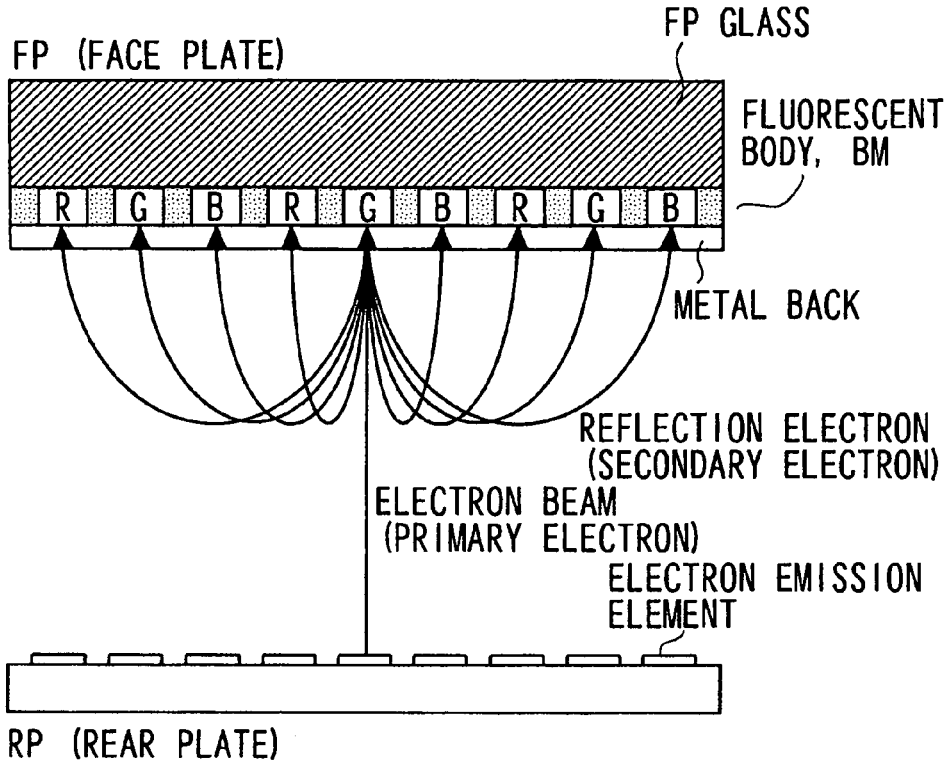
FIGS. 3A and 3B are explanatory views of a halation generation mechanism not in the vicinity of a spacer.

FIG. 3A shows a display panel for irradiating an electronic beam (a primary electron) to be emitted from the electron-emitting device to the luminous body and emitting a light from the luminous body. The electron-emitting device is formed on a rear plate and the luminous body (according to the present embodiment, the fluorescent body of each color, red, blue, and green) is arranged on a faceplate with an interval from the electron-emitting device.

Figure 3B:
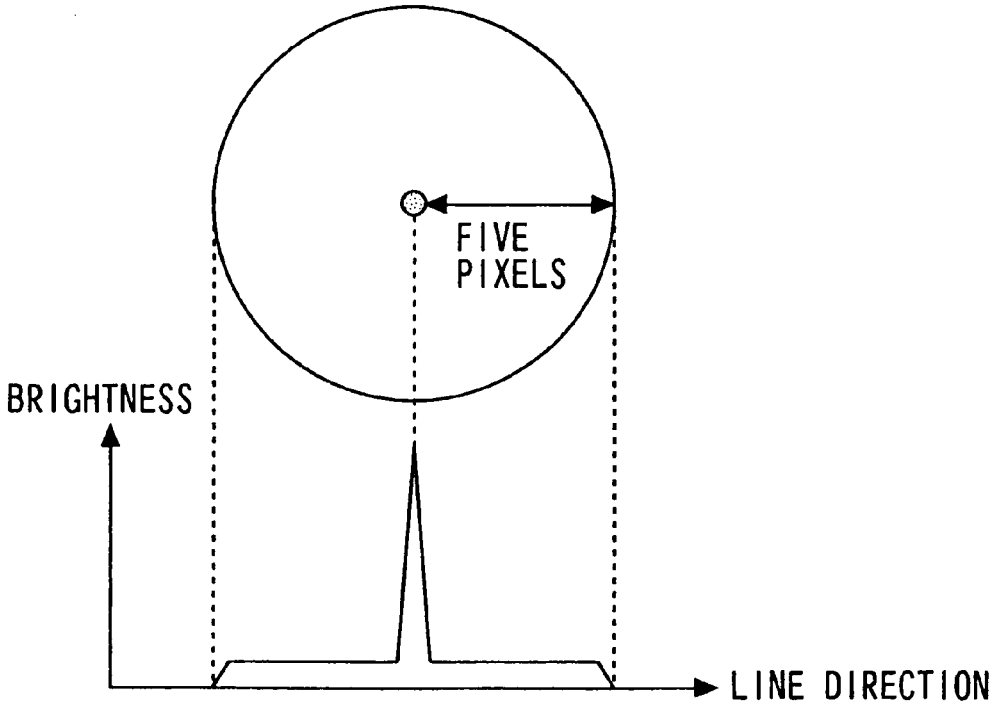
Figure 4A:
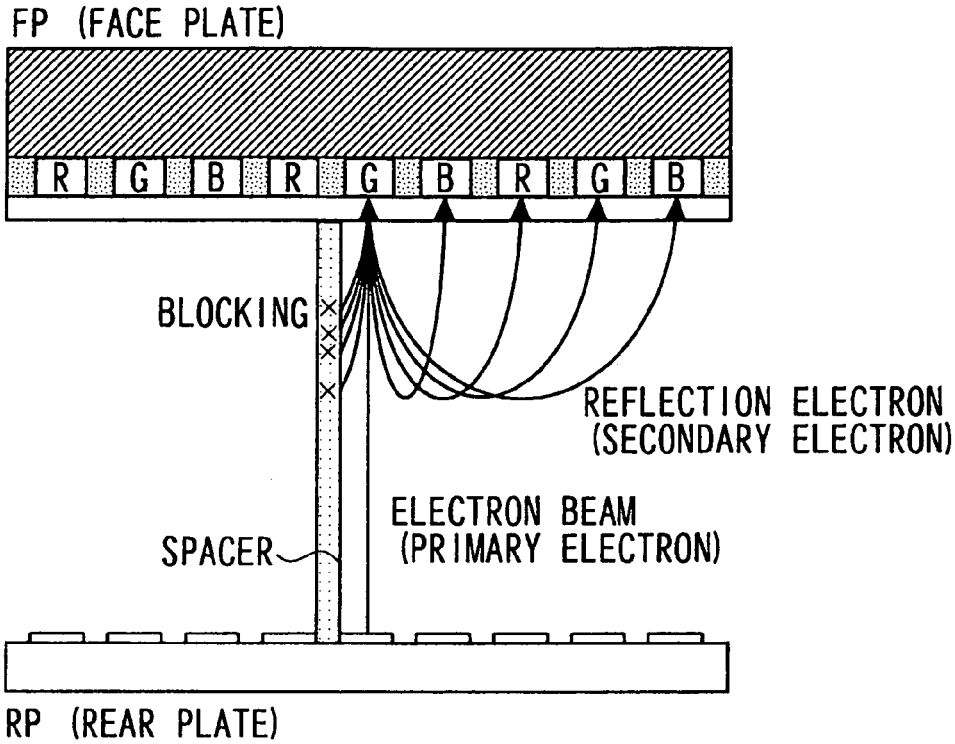
FIGS. 4A and 4B are explanatory views of a halation generation mechanism in the vicinity of the spacer.

The inventor of the present invention found that a specific problem such that a color reproduction property was different from a desired one in such a display panel was generated. According to a specific example, in the case of intending to obtain a light emission of blue by irradiating an electron only on a blue fluorescent body, it was found that the luminous state of not a pure blue but other color such as green and red mixed, namely, the luminous state having other color, namely, the luminous state having a bad color saturation was obtained. As a result of further studies, the inventor of the present invention confirmed that, in deterioration of the color saturation, not only the corresponding luminous body emits a light at a luminescent spot but also a peripheral luminous body (equivalent to "a light emission area" according to the present invention) emits a light when the primary electron to be emitted from the electron-emitting device enters the luminous body (equivalent to "a light emission area mainly emits light when the electron-emitting device is driven") corresponding to the electron-emitting device. It seems that this depends on the fact that the peripheral luminous body also emits light by inputting the primary electron inputted in the luminous body or an electron caused by the primary electron in near (also adjacent) light emission areas of different colors as a reflection electron (a secondary electron). In the present specification, the light emission of the near (also adjacent) luminous body due to this reflection electron is referred to as a halation. This is an example of a crosstalk, which is generated between the near pixels. In the display panel using the surface-conduction electron-emitting device (the constitution of the following embodiments), it was found that, when the electron is irradiated to one fluorescent body as shown in FIG. 3B, a circle light emission (distributed in a column shape around a luminescent spot when representing this as a luminance as the light emission amount) due to halation around the pixel of the electron was caused. FIG. 3A and FIG. 4A show "horizontal stripes", in which the fluorescent bodies are arranged alternately in R, G, and B in a linear direction. However, these horizontal stripes serve to make the explanation clearly understandable, and in fact the constitution of "vertical stripes", in which the fluorescent bodies are arranged alternately in R, G, and B in a horizontal direction, is employed.

If a radius of a circle area reached by this halation is formed by "a" pixels, a two-dimensional filter of 2a+1 tap is required as a pixel reference region for the halation correction processing to be described in later. Further, it was found that the radius of the area reached by the halation was decided uniquely depending on an interval between the face plate on which the fluorescent bodies are arranged and the rear plate on which an electron source is arranged, and a image size or the like. Accordingly, if the interval between the face plate and the rear plate is known, the number of a filter tap is uniquely decided.

An example to obtain the radius of the circle area reached by this halation will be described below. At first, a driving signal to emit light for only a predetermined pixel and not to emit light for other pixels is inputted. In this time, the pixel other than the pixel emitting light depending on the impacts of the halation slightly emits light. This light emission can be measured by providing a luminance measurement device at the outside of the display panel. It is possible to obtain the radius of the circle area reached by the halation from a size of the range reached by the halation and the size of one pixel.

Further, the radius of the circle area reached by the halation is obtained on the basis of the number of pixel in this case, however, the basis of the circle area reached by halation is not limited to this. In the case that one pixel is constituted from three sub pixels of R, G, and B, obtaining the radius of the circle area reached by the halation on the basis of the number of sub pixels and the number of the electron-emitting device corresponding to sub pixels, the present embodiment can be applied.

Figure 5:
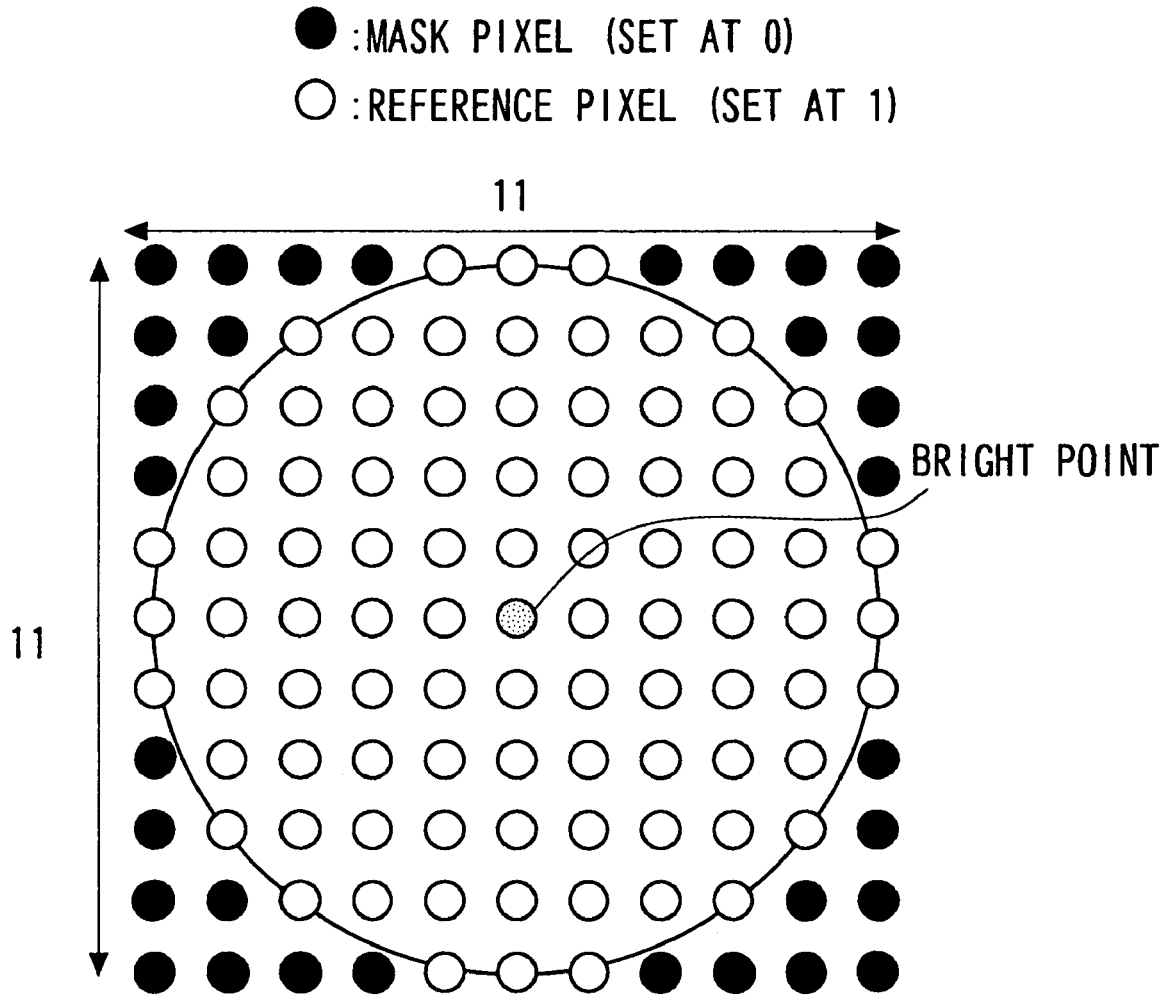
FIG. 5 is a halation mask pattern diagram of 11×11.

According to the present embodiment, an 11 tap filter is used assuming that the number of pixel is a=5 pixels. In other words, in order to consider a degree of impacts of the halation with respect to the luminescent spot caused by driving of the near (also adjacent) electron-emitting device, it is found that the data reference of 11 pixels×11 lines may be carried out as shown in FIG. 5. In other words, using the interested pixel (equivalent to a pixel including "the first electron-emitting device", "the second electron-emitting device" of the present invention as the sub pixel), which is a pixel of a correction target, as a reference position, the data corresponding to the pixel in the vicinity of the reference position and needing reference for correction of the crosstalk (equivalent to a pixel including "the third electron-emitting device", "the fourth electron-emitting device" of the present invention as the sub pixel) will be referred. In other words, it can be said that the distance between the first (the second) electron-emitting device and the third (the fourth) electron-emitting device according to the present invention is equal to or less than the distance between the light emission area farthest from the first light emission area among the light emission areas emitting light when the first electron-emitting device is driven and the first light emission area. In this case, the pixels are located in a circle with a radius of 11×pixel pitch around the interested pixel, and a distance between each of these pixels and the interested pixel is one satisfying a condition such that driving of each element increases brightness of the interested pixel. The reference region is a region including these pixels. Further, the region including the pixel needing reference can be appropriately set in accordance with the constitution of the display apparatus.

Figure 4B:
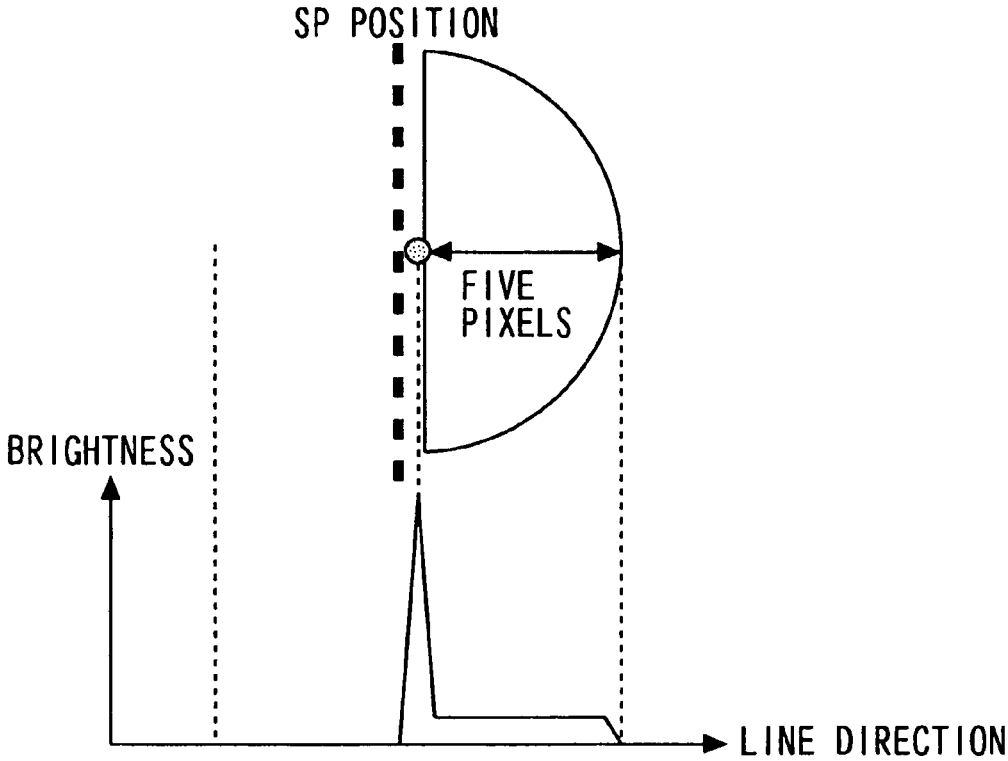

FIG. 3 shows the case that there is no shield member such as a spacer on a reflection orbit of a reflection electron (not in the vicinity of the spacer), and FIG. 4 shows the case that there is a shield member such as a spacer on the reflection orbit of the reflection electron (in the vicinity of the spacer). As shown in FIG. 4A, if the reflection electron (the secondary electron) is blocked by the spacer, the intensity of the halation is decreased by the pixel located at the opposite side of the spacer. Therefore, it was found that the region of the halation reached by the influence when the electron beam (the primary electron) is emitted from the electron-emitting device nearest to the spacer became a half circle of emission as shown in FIG. 4B. The above-described operation is a mechanism of generation of the halation, which is explained by taking a time of light emission from one element as an example.

On the display panel 20 used by the present embodiment, in order to support the face plate and the rear plate opposed with each other, spacers shaped so as to have a plurality of long plates elongated in a horizontal direction is mounted for every several tens lines in a vertical line direction. Then, for example, in the case of lighting the entire display panel with the same color like the case that the N pieces of electron-emitting devices are driven by the same driving signal, a difference of a halation amount is caused between the area in the vicinity of the spacer and the area not in the vicinity of the spacer due to the above-described halation. Thereby, it is confirmed that the vicinity of the spacer has a specific problem such that "a spacer unevenness" that a color purity is changed. Further, "the spacer unevenness" is also generated for the columnar spacer.

Figure 8A:
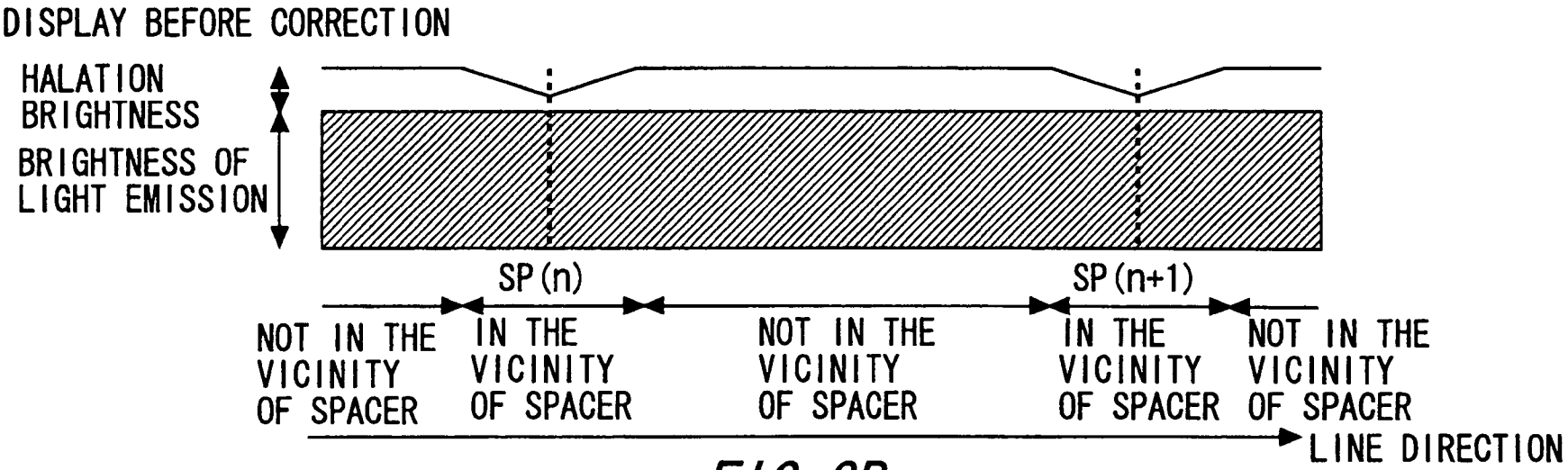
FIG. 8 is an image view of the halation correction due to addition.

The spacer unevenness is different depending on a lighting pattern of the displayed image. For example, when the entire display panel is lighted with blue, as shown in FIG. 8A, a halation luminance is added to a light emission luminance of blue. This halation luminance means a change amount (the halation luminance) caused by driving of the electron-emitting device having a light emission area other than a predetermined light emission area for light emission of the predetermined light emission area due to the inputted image data. In the vicinity of the spacer, a block amount of the reflection electron is changed step by step depending on a distance from the spacer, so that change of a color purity shaped in a stepwise wedge of a width about 10 lines can be viewed. This drop of the wedge-shaped luminance is the amount to be decreased by the spacer (the member) among the halation luminance. In this case, the electron-emitting device configuring the pixel not in the vicinity of the spacer in the drawing is equivalent to "the fifth electron-emitting device" according to the present invention. In other words the distance between the fifth electron-emitting device according to the present invention and the spacer is longer than the distance between the first (the second) electron-emitting device and the spacer.

Further, as the amount of the light emission of a predetermined light emission area, the luminance can be used. However, it is desirable that the halation from the elements on the different horizontal lines with respect to a light emission area on the predetermined horizontal line is also considered. As a result, as the amount of the light emission of a predetermined light emission area, specifically, an integration value of the luminance of the light emission area for a predetermined period (one frame period, and one vertical scan period) may be employed.

In consideration of a cause to generate the above-described spacer unevenness as a result of devotion and efforts, the inventor found a constitution of a new image display apparatus, which can improve an image quality of the display panel and a method for correcting the driving signal. Hereinafter, specific examples of the image display apparatus and the method of correcting the driving signal will be described with reference to FIG. 1.

It is assumed that the original image data (Rin, Gin, Bin) are output from the inversed γ correcting unit 11 shown in FIG. 2 and the original image data is inputted at each n bit. As described above, in order to carry out correction in consideration of the region reached by the impact of the halation, an 11×11 tap filter is needed, and in order to carry out the calculation processing, an 11 line memory is needed at the very least. According to this example, estimating a line memory amount necessary for correction, it is represented by:

[Mathematical Expression 1]

$$\text{a line memory capacity} = \text{the number of horizontal pixels} \times n \text{ bits} \times RGB \times 11 \text{ lines} \quad \text{(Expression 1)}$$

For example, in the case of carrying out a high gradation display with the number of horizontal pixel=1,920 pixels, and n=16 bit, the line memory capacity for correction becomes an enormous amount, namely, 1,920×16×3×11=1,014 kbit. If a memory for calculation of such amount is mounted on an LSI for signal processing as it is, a die size becomes larger and a chip cost is largely increased.

Next, the structure capable of reducing the above-described line memory capacity for correction according to the present embodiment will be described with reference to FIG. 1.

<Thinning-Out Processing Unit 1>

A thinning-out processing unit 1 may carry out the processing to reduce the original image data and give it to a first memory 2. As a method to reduce the original image data, two examples will be described below. The first method is one to reduce the number of reference bit of the data for calculation. For reference of the data for calculation, top m bits among n bits of the original image data (n>m) are used, and an m value is decided to be covered in an error rate that the calculation precision of halation correction is not lowered. In the case of the halation correction, when the output of the above-described inversed γ correcting unit 11 is in the range of n=12 to 16 bits, it becomes apparent that the number of reference bit can be reduced till m=8 bits in the experiment. This is why the halation amount is calculated by multiplying the total lighting amounts of the reference pixels by a certain minute coefficient and a resolution performance of the reference pixel is decided depending on this minute coefficient. The second method is one to approximate the above-described extent of the impact of the halation not as a RGB element unit but a pixel unit. Specifically, as expressed by an equation: Pixel (m+2 bits)=R (m bits)+G (m bits)+B (m bits), the lighting amount for each RGB element is added and this represents the total lighting amount of the pixel unit. According to these two methods to reduce original image data, the reduction rate of the line memory capacity=(m/n)×((m+2)/3 m)=(8/16)×(10/24)=0.21 is established. Without reduction of the correction precision till 213 kbit, which is 21% of 1,014 kbit, it is possible to reduce the capacity of the first memory 2.

<First Memory 2>

The first memory 2 is configured by 11 line memories. The first memory 2 is writing the original image data thinned out by the thinning-out unit 1 in a line unit in series. At the time when the data for 11 lines is stored, for reference of calculation, the data for 11 pixels×11 lines is read simultaneously from the first memory 2. Such a structure capable of reading at the same time is desirable for the first memory 2, so that it is preferable that the line memory is configured by a SRAM structure. To that end, a RAM within an LSI such as ASIC or FPGA is preferably used. Further, reading of the data of 11 pixels×11 lines is carried out with respect to the original image data moving in a row direction (a column direction) for each pixel.

<Reconstruction Unit 3>

A reconstruction unit 3 may restore the data amount by making the amount of reducing 11 pixels×11 line data, which is read from the first memory 2 at the same time, by the thinning-out unit 1 $2^{n-m}$ times.

<Selective Addition Unit 4>

At first, a selective addition unit 4 masks 11 pixels×11 line data with a halation mask (FIG. 5) showing the information about the peripheral pixels influenced by the reflection electron (the secondary electron) for the interested pixel (the luminescent spot) (the pixel amount of the mask area becomes 0). Next, the selective addition unit 4 may add only the amount of blocking the peripheral pixels by the spacer of the reflection electron as the total lighting amount relating to the blocking amount of the interested pixel in the vicinity of the spacer. Specifically, the selective addition unit 4 may obtain the total lighting amount relating to the block amount by determining whether or not the interested pixel of 11 pixels×11 line data is located in the vicinity of the spacer. A SPD value will be described below. Further, the selective addition unit 4 may be also configured so as to selectively add only the blocked amount by the columnar spacer as the total lighting amount relating to the blocked amount of the interested pixel in the vicinity of the spacer.

<Spacer Position Information Generation Unit 5>

Figure 6:
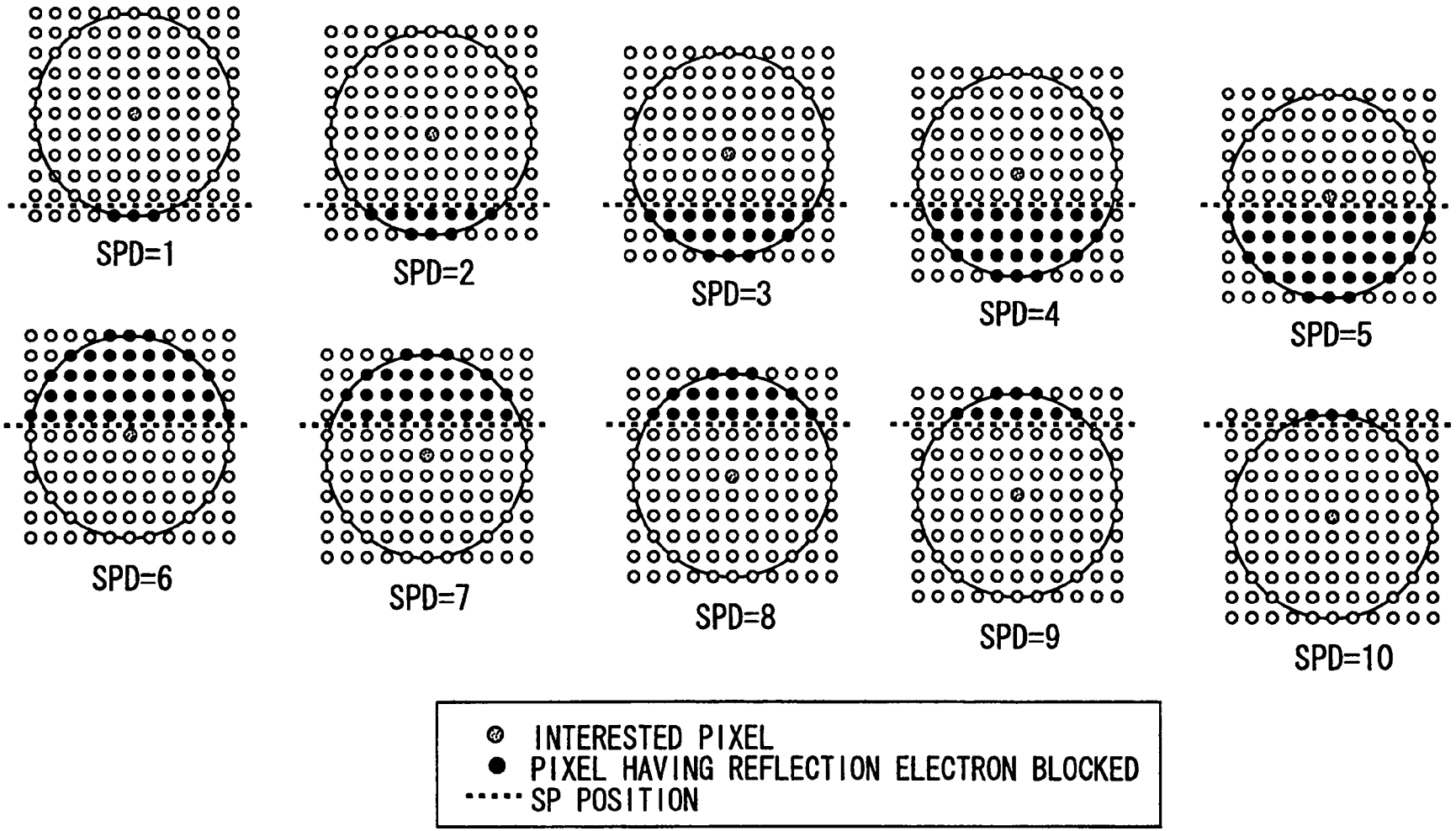
FIG. 6 is a corresponding view of a pixel area where a reflection electron is blocked depending on a distance between an interested pixel and a spacer.

A spacer position information generation unit 5 may generate (i) a timing control signal received from the timing controlling unit 13 and (ii) the SPD value (Spacer Distance) showing a positional relation between the interested pixel and the spacer on the basis of the spacer position information. There are 10 patterns of the pixels corresponding to the blocked reflection electrons in the interested pixel in the vicinity of the spacer depending on the SPD values as shown in FIG. 6. Then, the SPD values of 1 to 10 are allocated to each pattern. As being understandable from FIG. 6, "the first electron-emitting device" and "the third electron-emitting device" according to the present invention are located at the opposite side with respect to the spacer. In the same way, "the second electron-emitting device" and "the fourth electron-emitting device" according to the present invention are located at the opposite side with respect to the spacer. The total lighting amount relating to the blocked amount can be obtained by selecting the pixel represented by gray in accordance with the SPD value and adding all of the values of these pixels. Further, one pixel has a light emission area of red (R), green (G), and blue (B). The input signal employs the structure to be inputted as an R signal, a G signal, and a B signal corresponding to one pixel, respectively. The selective addition unit 4 may carry out multiplication of the data relating to the blocked amount for each color, calculate a sum of the results of this multiplication of each color, R, G, and B, and output it. Not in the vicinity of the spacer, blocking due to the spacer of the reflection electron is not caused, so that the additional result may be 0.

<Coefficient Multiplication Unit 6>

A coefficient multiplication unit 6 may multiply a coefficient (a halation gain value) showing what percentage of the additional result becomes the blocked halation amount by the additional result so as to calculate the correction value. Generally, the coefficient takes a value between 0 and 1. The correction value is a value equal to or less than 0.03% of the brightness of the luminescent spot of the reference pixel in a real panel. The correction value calculated by the coefficient multiplication unit 6 is stored in a second memory 7. Further, a circuit till the correction value is calculated by the coefficient multiplication unit 6 is equivalent to "a first circuit" of the present invention.

<Second Memory 7>

The second memory 7 (equivalent to "a storage unit" according to the present invention) may store the calculated correction value in order to adjust timing so as to relate the pixel position to a predetermined pixel position of the original image data which is not routed through the first memory 2. According to the present embodiment, in order to delay timing for one frame, the second memory 7 serves as a frame buffer for storing a representative value to be described later therein. In other words, the second memory 7 functions as a timing adjusting buffer, so that it is preferable to used an economy device such as the external DRAM.

<Correction Calculation Unit 8>

A correction calculation unit 8 (equivalent to "a third circuit" of the present invention) may read the correction value from the second memory 7 after one frame. The correction calculation unit 8 may add each correction value to each of original image data Rin, Gin, and Bin as Rout=Rin+Correction Value, Gout=Gin+Correction Value, Bout=Bin+Correction Value so as to output correction data Rout, Gout, and Bout, respectively.

Figure 8B:
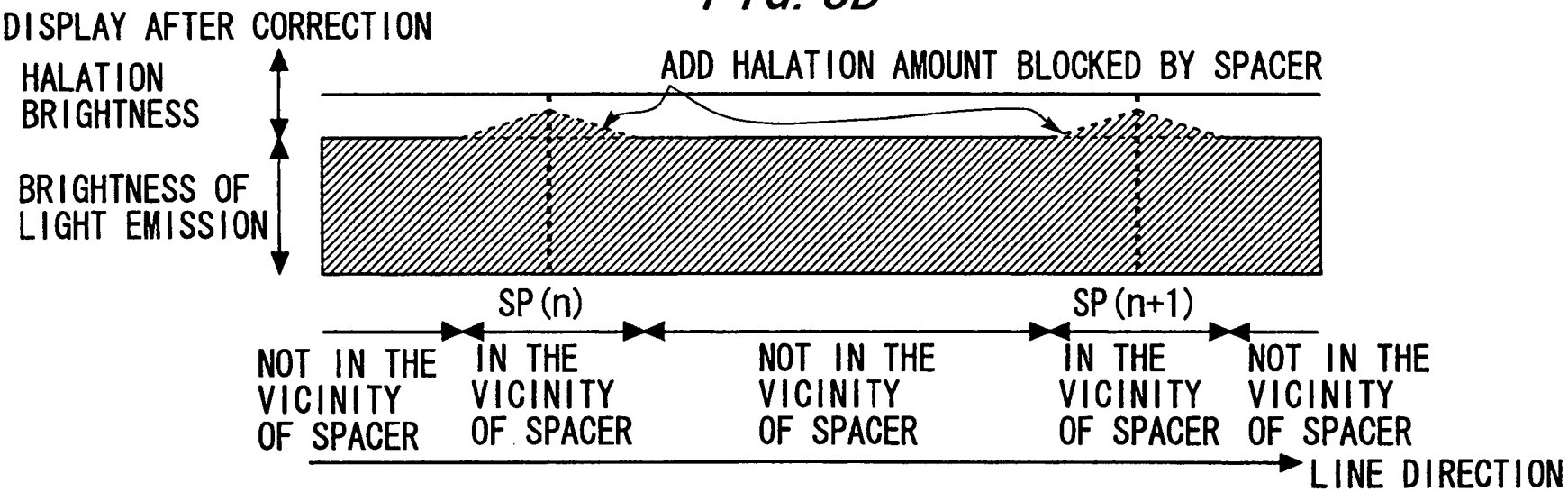

As described above, a system that the correction calculation is separated into the first memory and the second memory in order to reduce a cost without decreasing correction precision has been explained. Upon employing of the above-described method, a bad effect due to reflecting the correction value after one delay frame is feared, however, such a bad effect could not be viewed and a good correction result could be obtained in the experiment. It seems that this is why a general image has correlation between the frames and a difference after one delay frame cannot be detected in many cases. Even an image with weak frame correlation (for example, an image that a white rectangular area is moving for each frame on a black background or the like) cannot be viewed, so that the good correction result can be obtained. It seems that this is why the correction value of the halation is small, namely, 0.03% of the brightness of the luminescent spot as described above and this exceeds a detection limit (hereinafter, referred to as "a detection limit") of human eyes with respect to change of the brightness as the correction error. Thereby, a gradual change of color purity in the vicinity of the spacer generated before correction shown in FIG. 8A is corrected being added with the correction amount of the halation for the amount of the reflection electron blocked in the vicinity of the spacer. After correction, as shown in FIG. 8B, a difference of the color purity between the no-vicinity of the spacer and the vicinity of the spacer is decreased so as to be able to eliminate spacer unevenness due to the halation.

In other words, a correction circuit according to the present invention may carry out correction so as to compensate a difference between the brightness of the pixel not in the vicinity of the spacer (the pixel configured by "the fifth electron-emitting device" of the present invention) and the brightness in the vicinity of the spacer (the pixel containing "the first electron-emitting device" of the present invention as a sub pixel, the pixel containing "the second electron-emitting device" of the present invention as the sub pixel, and the pixel containing "the first and second electron-emitting devices" of the present invention as the sub pixel). Further, as in the present embodiment shown in FIG. 8, a distance between "the fifth electron-emitting device" in the case of providing a plurality of spacers and a spacer SP (n) is longer than a distance between the interested element which is the pixel of the correction target and the spacer SP (n) and is shorter than a distance between "the fifth electron-emitting device" and a spacer SP (n+1).

Here, a problem of a correction resolution performance in the above-described correction method will be considered. Generally, the higher limit of the correction capability is decided by a display capability (a gradation capability) of the display apparatus, and if the display capability is improved, for example, from 10 bit to 16 bit, the correction capability should be improved in accordance with this. However, since the data amount of the correction value is also increased, when there is a memory device in the processing system as in the present embodiment, a bad effect that the correction capability is limited is generated. According to the present embodiment, it is preferable for the second memory 7 to select an inexpensive device such as an external DRAM, however, there is a limitation in a transmission band of the memory since such an inexpensive device is a general-purpose commodity. This is why the band of the memory device is generally expanded in integral multiplication of the data 8-bit width. For example, taking the case of selecting the inexpensive structure made of one piece of SDRAM of a data width 32 bits and a clock 133 MHz for the second memory 7 as an example, a transmission band of a memory=133 MHz×32 bits×efficiency 80%=3,404 Mbps is established.

On the other hand, the case of carrying out the above-described correction processing at a video rate of an FHD (1080 p, 60 Hz, a dot clock 140 MHz) is as follows:

In the case of <Halation Correction Value=8-bit width>, a necessary transmission band=74.25 MHz×2×8 bits×2 (read/write)=2,376 Mbps is established.

In the case of <Halation Correction Value=16-bit width>, a necessary transmission band=74.25 MHz×2×16 bits×2 (read/write)=4,752 Mbps is established.

Therefore, in the case of 8-bit width, the memory device 2 can be configured by one piece of SDRAM, however, in the case of 16-bit width, it can be roughly estimated that two pieces of SDRAM are required and the manufacturing cost thereof becomes two times as an example.

FIG. 7 is a graph showing a relation of a correction capability in accordance with a proximity of a spacer when a driving duty (duty) is changed. FIG. 7 represents a correction capability in accordance with a degree of proximity from the spacer (from a first proximity to a fifth proximity) taking the driving duty on a horizontal axes and taking a relative error on a vertical axes.

Here, the driving duty is a ratio of the sum of the current lightning pixel levels with respect to the sum of the all white lightning levels at a reference pixel level to influence the halation correction with respect to the interested pixel (the luminescent spot) shown in FIG. 5, and specifically, the driving duty is represented as the following expression 2.

[Mathematical Expression 2]

$$\text{A driving duty} = \text{a sum of current lightning pixel levels} / \text{a sum of all white lightning levels} \quad \text{(Expression 2)}$$

In other words, the driving duty is 1 when the entire screen is lightning white, and the driving duty is ⅓ when the entire screen is lighting a single color, R, G, and B. Then, the relative error is an error between the ideal calculation result and the N bit calculation result including a round error, and specifically, the relative error is represented by the following expression 3.

[Mathematical Expression 3]

A relative error=(Ideal Calculation Result−$N$-bit Precision Calculation Result)×100/Ideal Calculation Result ($N$=12 or 16) (Expression 3)

According to FIG. 7, as the spacer is separated from the most proximity (the first proximity) to the fifth proximity and as the gradation level is changed from a bright part to a dark part (as the driving duty is decreased), it is found that the correction capability is lowered.

Figure 7A:
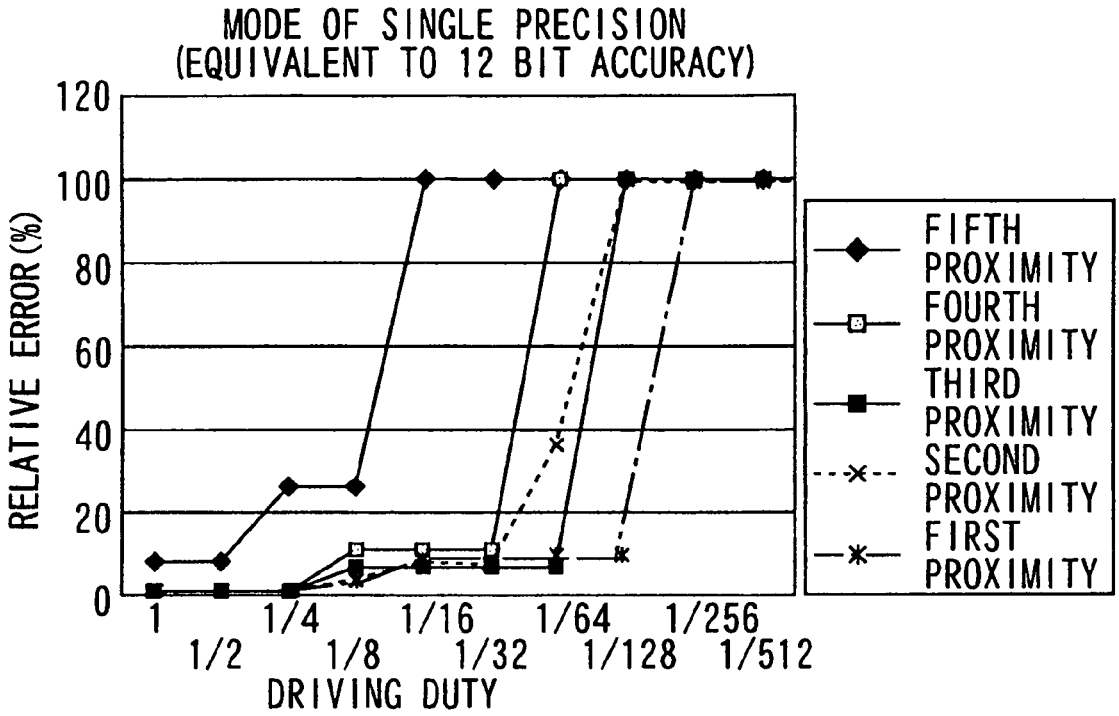
FIGS. 7A and 7B are graphs showing a relation of a correction capability depending on proximity when a driving duty is changed.

FIG. 7A shows a correction capability about the case that the halation correction value is defined as an 8-bit width (equivalent to a 12-bit precision). A limit (a detection limit) that the space unevenness after the correction cannot be identified in the real panel precisely coincides with the result shown in FIG. 7A since a ¼ driving duty is known to be a threshold value from the experiment of a subjective evaluation. With respect to the fifth proximity (SPD=1 and 10 of FIG. 6) where the interested pixel is farthest from the spacer, the relative error becomes large as the relative error is lowered from a ½ driving duty (becomes dark). However, since the influence amount of blocking is very small, in fact the spacer unevenness after correction cannot be identified (exceeding "the detection limit").

Figure 7B:
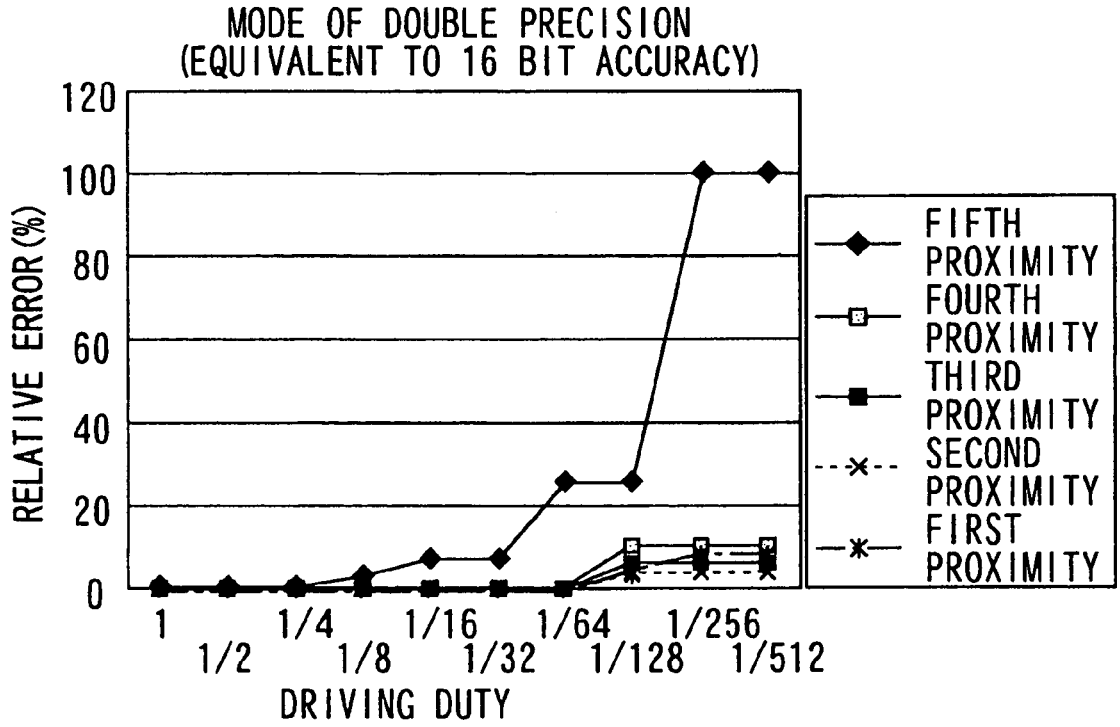

FIG. 7B shows a correction capability in the case of making a halation correction value into a 16-bit width (equivalent to a 16-bit precision).

As the above-described result of the 8-bit width, according to the correction capability of a 16-bit width, it is known that a correction capability range can be enlarged 16 times as large as that of 8 bit till a 1/64 driving duty in consideration from the first proximity to the fourth proximity. This is why the correction data of a 12-bit precision at an 8-bit width is realized and the correction data of a 16-bit precision at a 16-bit width is realized according to the present embodiment. However, if the correction processing is carried out at a 16-bit width receiving the above-describe result as it is, it becomes difficult to pursuit the manufacturing cost and the correction capability at the same time.

Therefore, according to the present embodiment, a method only to improve a correction capability without change of a manufacturing cost will be described with reference to FIG. 9.

<Average of a Correction Value>

FIG. 9 is a view for explaining a halation correction system for averaging a correction value between the adjacent pixels. In FIG. 9, a data averaging unit 30 and a data reconstruction unit 31 are added to the block diagram shown in FIG. 1 backward and forward of the second memory 7.

<Data Averaging Unit 30>

The data averaging unit 30 (equivalent to "the second circuit" of the present invention) may carry out ½ data thinning-out by representing the halation correction value with the correction value of a group of the adjacent pixels (two adjacent pixels) in a parallel direction with the spacer. In this time, the correction value of a 16-bit width is stored in the second memory 7. There is a tendency that the halation unevenness becomes remarkable in an image having a low space frequency (an image lighted at the same color on the entire panel or the like), so that even if the correction value is thinned-out between the adjacent pixels, the degree of the precision of the correction is not lowered so much.

FIG. 9 shows an example of averaging correction values A and B of the adjacent pixels and creating a correction value C as a representative value. Thereby, without increase of a necessary band of a memory (without increase of a cost), it is possible to secure a correction resolution performance of a double precision.

<Data Reconstruction Unit 31>

The data reconstruction unit 31 may read the correction value C from the second memory 7 to carry out the reconstruction using the same correction value C and the pixels in the adjacent pixel group may carry out the reconstruction using the same correction values C. The data reconstruction unit 31 may supply two reconstructed correction values C to the correction calculation unit 8 (FIG. 9 shows an example that both of the correction values in the adjacent pixels use the correction value C). Particularly, according to the present embodiment, a spacer having a platy shape which is longer in a horizontal direction is arranged.

The selecting method of the adjacent pixel group is not limited to two pixels to be adjacent in a parallel direction with the spacer as in the present embodiment. As other example, a pieces ($a \geqq 2$) adjacent to the spacer in a parallel direction; b pieces ($b \geqq 2$) adjacent to the spacer in a vertical direction; and a×b pieces of pixels including a pieces ($a \geqq 2$) adjacent to the spacer in a parallel direction and b pieces ($b \geqq 2$) adjacent to the spacer in a vertical direction or the like may be considered. Further, in the case of making a plurality of pixels to be adjacent in a vertical direction with the spacer into an adjacent pixel group, the pixels configuring the adjacent pixel group may be located at the opposite side of the spacer.

Here, since the change amount in the distribution of the halation correction amount of an image with a low space frequency is small in a parallel direction than in a vertical direction, averaging of the pixels to be adjacent in a parallel direction is a preferable method. Particularly, as in the present embodiment, it is preferable to make two pixels adjacent in a parallel direction to the spacer into an adjacent pixel group.

In addition, the number of the reference pixels becomes equal for the pixels (the first electron-emitting device, and the second electron-emitting device) having the same distance from the spacer in the adjacent group. If the number of the reference pixels is the same, the values of the correction values (A, B) intend to be approximated, so that the representative value (the correction value C) approximates the value of the correction values (A, B).

In the case that the spacer having a platy shape which is longer in a vertical direction is arranged, averaging of the pixels adjacent in a vertical direction may be carried out with the same concept.

With respect to thinning-out among the data of the correction values, according to the present embodiment, an example to average the adjacent pixel group by additional averaging in two pixel units is shown as follows:

[Mathematical Expression 4]

A correction value $C$=Ave (a correction value $A$+a correction value $B$) (Expression 4)

However, depending on a condition, the averaging may be carried out by the weighted averaging among the pixels as follows:

[Mathematical Expression 5]

A correction value $C=(1-\alpha)\times$a correction value $A+\alpha\times$a correction value $B$($\alpha$ is a weighting coefficient, $0 \leqq \alpha \leqq 1$) (Expression 5)

Here, when $\alpha$ is 0 or 1, the all pixels in the adjacent pixel group should be corrected by the correction value of one pixel in the adjacent pixel group. This case is also included in the example of calculating the representative value (the correction value C) by using two correction values (A, B).

Further, in the case of using the display panel that the halation amount of the display panel 20 is decreased from the halation amount according to the present embodiment to ½ or less, it is estimated that the influence amount due to the halation is also decreased to ½ or less. Therefore, the adjacent pixel group may be made of not two pixels but three or more pixels. For example, enlarging to unit of four pixels, ¼ data thinning-out may be carried out as follows:

[Mathematical Expression 6]

A Correction Value $E$=Ave (a correction value $A$+a correction value $B$+a correction value $C$+a correction value $D$) (Expression 6)

In this case, the correction capability range can be enlarged to 1/128, which is double as large as the former one.

As described above, according to the present embodiment, the degree of the halation correction precision can be improved without increase of the band of the memory for storing the correction value therein also for improvement of the signal processing resolution performance. In addition, an expression approximating any expression may be employed if the same effect as the case of using any expression among the fourth to sixth expressions.

In other words, in the constitution to calculate a representative value by using the correction value of the driving signal for driving each electron-emitting device of the adjacent pixel group, even when the correction value of the driving signal is obtained according to a different method from the above-described expression, the present effects of the invention can be obtained. Further, according to the present embodiment, the constitution to obtain the representative value by using a plurality of correction values in the adjacent pixel group is disclosed, however, the present invention is not limited to the pixel unit. In other words, even in the constitution of calculating the representative value by using a plurality of correction values in the group made of the approximating plural sub pixels, the present effects of the invention can be obtained.

Second Embodiment

According to the first embodiment, a method to correct the bright part and the dark part by a double precision (equivalent to a 16-bit precision) without exception is described. On the other hand, as described above, there is an experimental result that the spacer unevenness after correction cannot be identified (exceeding "the detection limit") in a range of ¼ driving duty position to 1 driving duty (the bright part) Therefore, according to the present embodiment, a manner that the correction resolution performance in the horizontal direction is corrected only in the bright part with a single precision, so that the constitution thereof will be described below.

In this constitution, not as in the above-described embodiment, this is not fixed to the correction processing at the double precision, but each advantage is taken by applying any one of the correction methods of a double precision or a single precision (equivalent to a 12-bit precision) in accordance with the driving duty.

For example, when the driving duty is ¼ or more (the bright part) in FIG. 7, the correction is made at a single precision as shown in FIG. 7A, and when the driving duty is ¼ or more, the correction is made at a double precision as shown in FIG. 7B. In this way, maintaining a correction resolution performance in a horizontal direction in the bright part, it is possible to correct the dark part at a high precision.

Figure 10:
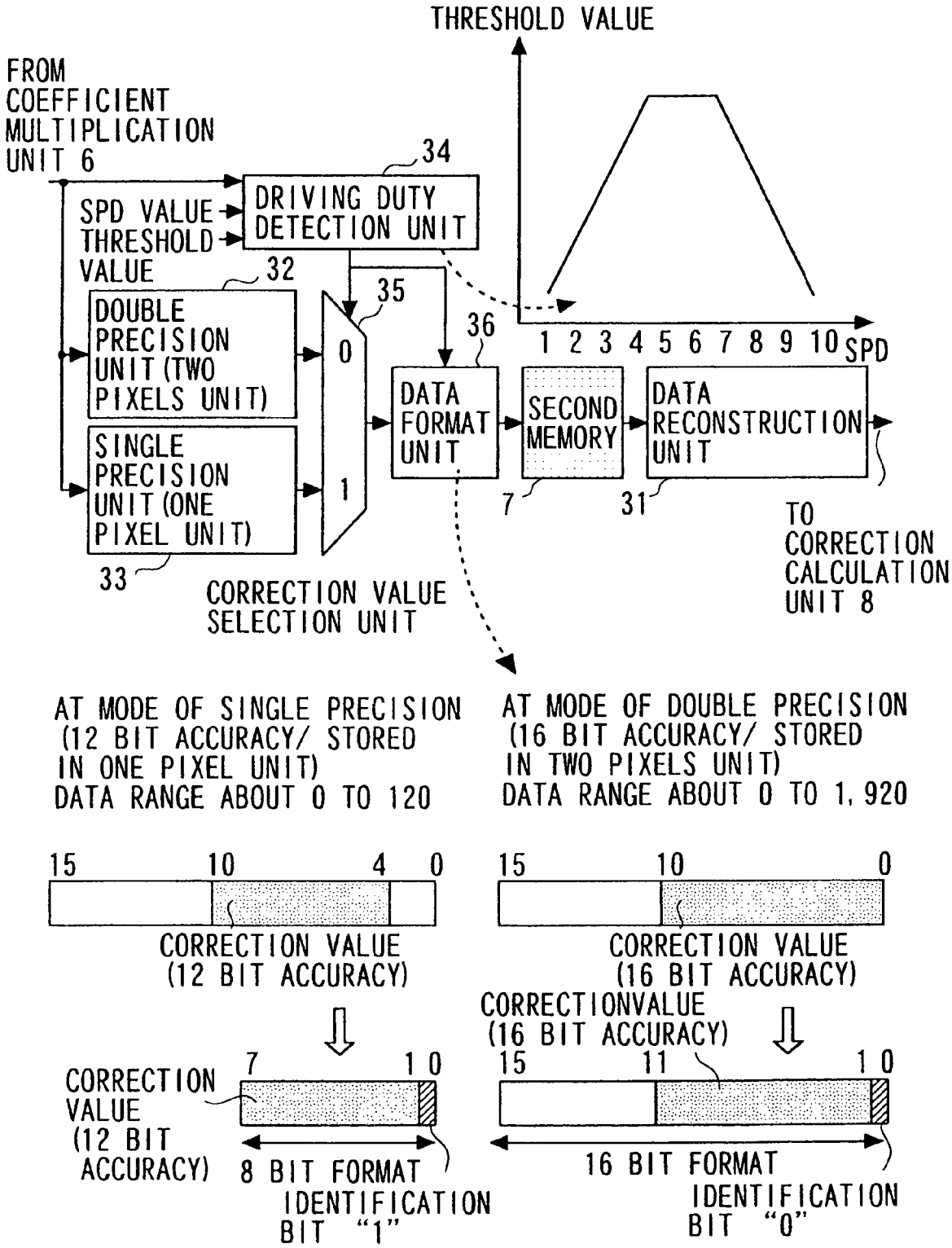
FIG. 10 is an explanatory view of a halation correction system that a correction precision is changed depending on the driving duty.

With reference to FIG. 10, a specific method will be described.

A double precision unit 32 is a system to double the precision by using the method according to the first embodiment. In other words, the double precision unit 32 may calculate a representative value (a correction value C) for correcting a driving signal in order to drive each electron-emitting device of the adjacent pixel group in the above-described embodiment. In addition, a single precision unit 33 is a system to make the precision into single in one-pixel units by reducing the data amount. In other words, the single precision unit 33 may calculate a small value of the data amount than the correction value outputted from the coefficient multiplication unit 6. Then, the correction value outputted from the coefficient multiplication unit 6 is processed by two systems, namely, the double precision unit 32 and the single precision unit 33, respectively.

A driving duty detection unit 34 is a comparison unit to output a control signal (0 or 1) for changing a single precision with a double precision as comparing a threshold value with the correction value outputted from the coefficient multiplication unit 6. The correction value outputted from the coefficient multiplication unit 6 can be treated as being equal to the driving duty value, so that, according to the present embodiment, not the driving duty value but the correction value is used as it is. Therefore, from as being obvious from the above description, as the threshold value, the correction value equivalent to ¼ driving duty value may be simply set. However, as shown in FIG. 6, the correction value to be outputted from the coefficient multiplication unit 6 has a different reference amount (the number of the reference pixels) depending on the SPD value, so that the driving duty detection unit 34 is constituted so as to vary the size of the threshold value in accordance with the SPD value.

For example, the driving duty detection unit 34 may output a control signal as comparing the correction value outputted from the coefficient multiplication unit 6 with the threshold value. When the correction value is equal to or more than the threshold value, the driving duty detection unit 34 may output a control signal (1) for selecting the output from the single precision unit 33, and the correction value is smaller than the threshold value, the driving duty detection unit 34 may output a control signal (0) for selecting the output from the double precision unit 32.

A correction data selection unit 35 may select the output from the double precision unit 32 or the output from the single precision unit 33 in accordance with the control signal from the driving duty detection unit 34.

Next, a data format unit 36 may adjust a format of the correction value to be stored so as to be covered by a band of the second memory 7. Specifically, as shown in FIG. 10, at a single precision mode, the correction value is represented by a 12-bit precision/one pixel and the data range is covered by 0 to 120, so that the correction value can be covered in an 8-bit width even when one bit is added thereto. Therefore, the format of the correction value is converted into a format of a correction value (7 bits)+identification (one bit) On the other hand, at a double precision mode, the correction value is represented by a 16-bit precision/one pixel and the data range is covered by 0 to 1,920, so that the correction value can be covered in a 16-bit width even when one bit is added thereto. Therefore, the format of the correction value is converted into a format of a redundant part (4 bits)+a correction value (11 bits)+identification (one bit). In this format, the correction value is stored in the second memory 7 in the same way.

Then, seeing an identification bit (0 or 1) that the correction value read after one frame is allocated to an LSB, the data reconstruction unit 31 may make the correction value of 7 bits 16 times at a single precision mode (the identification bit is 1), and the correction value of 11 bits is reconstructed as it is at a double precision mode (the identification bit is 0). This reconstructed correction value is added to the original image data by the correction calculation unit 8.

As described above, by using the correction method to change the precision of the correction adaptively in accordance with the driving duty, it is possible to correct the value till the dark part with a high precision while maintaining a correction resolution power in a horizontal direction at the bright part.

Third Embodiment

According to the above-described embodiment, the constitution that the correction value equivalent to the part blocked by the spacer is calculated in the increment of brightness that can be given to brightness of the correction target pixel by the pixel located in the vicinity of the correction target pixel is shown. The correction value obtained by the calculation is calculated for the correction target data so as to enlarge the correction target data. Thereby, in the pixel located in the vicinity of the spacer, the increment of brightness by the halation is given in a pseudo manner as if there is no spacer near.

On the other hand, the present embodiment is constituted so that the pixel (equivalent to the pixel including "the third electron-emitting device", "the fourth electron-emitting device" of the present invention as a sub pixel) located in the vicinity of the correction target pixel (equivalent to the pixel including "the first electron-emitting device", "the second electron-emitting device" of the present invention as a sub pixel) calculates the correction value equivalent to increment of brightness to be given to brightness of the correction target pixel. Here, due to the obtained correction value, correction is made so that the brightness of the correction target pixel is reduced for brightness to be given to the correction target pixel by the pixel located near. In other words, the correction value of the first (the second) driving signal is a correction value to compensate the brightness of the first (the second) light emission area generated when the third (the fourth) electron-emitting device is driven.

The constitution of the halation correction unit according to the present embodiment is the same as the above-described embodiment(s). However, the operations of the selective addition unit 4 and the correction calculation unit 8 are different from the above-described embodiment(s).

The operation is controlled respectively as follows depending on the case that the correction target pixel is sufficiently separated from the spacer and the case that the spacer is located in the vicinity of the spacer.

In the case that the correction target pixel is sufficiently separated from the spacer If there is no spacer located near between the pixel (the near pixel) which can give the influence due to the halation on the correction target pixel and the correction target pixel, the effect to block the halation by the spacer is not influenced on this correction target pixel. As a result, the selective addition unit 4 may multiply all of the data of the near pixel on the driving line.

In the case that the spacer is located in the vicinity of the spacer

In the vicinity of the spacer, only the data of the near pixel on the driving line located at the same side as the correction target pixel for the spacer among the near pixels is added.

By using the multiplied value obtained in the above-described manner, the correction value is calculated as same as the above-described embodiment.

The present embodiment is constituted so as to reduce the increment of brightness generated by the halation by the correction, so that the correction calculation unit 8 may carry out the processing to subtract the correction value from the correction target data. Thereby, the display apparatus can realize the display as if no halation is generated.

As being obvious from the above description, the present embodiment can be applied also to the constitution using no spacer. In the case of the display panel using no spacer or no member equivalent to the spacer, the processing when the correction target pixel is sufficiently separated from the spacer may be done in the all areas.

In addition, it is also possible to combine the present embodiment with the second embodiment.

Here, the example of the display apparatus using the surface-conduction electron-emitting device is cited, however, the crosstalk as described here as halation can be generated in any electron ray display apparatus such as an FED.

This application claims the benefit of Japanese Patent Application No. 2005-377894, filed Dec. 28, 2005, and Japanese Patent Application No. 2006-329286, filed Dec. 6, 2006, which are hereby incorporated by reference herein in their entirety.

What is claimed is:

1. An image display apparatus, comprising:

first to N-th electron-emitting devices (N is an integer number of 5 or more);

a spacer;

a driving circuit for correcting each of first to N-th driving signals for driving the first to N-th electron-emitting devices and outputting the corrected driving signals; and first to N-th light emission areas;

wherein a K-th light emission area (K is an integer number of 1 or more to N or less) mainly emits light when a K-th electron-emitting device is driven;

a distance between the fifth electron-emitting device and the spacer is longer than a distance between the first electron-emitting device and the spacer and is longer than a distance between the second electron-emitting device and the spacer;

the first electron-emitting device and the third electron-emitting device are located at an opposite side with respect to the spacer;

a distance between the first electron-emitting device and the third electron-emitting device is equal to or less than a distance between the light emission area farthest from the first light emission area among the light emission areas emitting light when the first electron-emitting device is driven and the first light emission area;

the second electron-emitting device and the fourth electron-emitting device are located at the opposite side with respect to the spacer;

a distance between the second electron-emitting device and the fourth electron-emitting device is equal to or less than a distance between the light emission area farthest from the second light emission area among the light emission areas emitting light when the second electron-emitting device is driven and the second light emission area; and the driving circuit has a correction circuit;

wherein the correction circuit has:

a first circuit for calculating correction values for correcting the driving signals;

a second circuit for calculating a representative value by using a plurality of correction values for correcting the driving signal for driving each electron-emitting device of a group consisted of near M pieces of electron-emitting devices (M is an integer number of 2 or more to N or less) including the first and second electron-emitting devices;

a storage unit for storing the representative value; and a third circuit for correcting the driving signals for driving each electron-emitting device of the group by using the representative value;

wherein a correction value for correcting the first driving signal is a correction value, which depends on the third driving signal and can compensate a difference between a brightness of the fifth light emission area and a brightness of the first light emission area when the N pieces of electron-emitting devices are driven by the same driving signal; and a correction value for correcting the second driving signal is a correction value, which depends on the fourth driving signal and can compensate a difference between a brightness of the fifth light emission area and a brightness of the second light emission area when the N pieces of electron-emitting devices are driven by the same driving signal.

2. The image display apparatus according to claim 1, wherein the spacer is a platy spacer; and the first and second electron-emitting devices are arranged in a parallel direction with the spacer.

3. The image display apparatus according to claim 1, wherein a distance between the first electron-emitting device and the spacer is equal to a distance between the second electron-emitting device and the spacer.

4. The image display apparatus according to claim 1, wherein the correction circuit has a selection unit; and the selection unit selects a driving signal which is corrected for driving each electron-emitting device of the group by using the representative value or a driving signal corrected for driving each electron-emitting device of the group by using a value having the smaller data amount than that of the correction value.

5. An image display apparatus, comprising:

first to N-th electron-emitting devices (N is an integer number of 4 or more);

a driving circuit for correcting each of a first to N-th driving signals for driving the first to N-th electron-emitting devices and outputting the corrected driving signals; and first to N-th light emission areas;

wherein the K-th light emission area (K is an integer number of 1 or more to N or less) mainly emits light when the K-th electron-emitting device is driven;

a distance between the first electron-emitting device and the third electron-emitting device is equal to or less than a distance between the light emission area farthest from the first light emission area among the light emission areas emitting light when the first electron-emitting device is driven and the first light emission area;

a distance between the second electron-emitting device and the fourth electron-emitting device is equal to or less than a distance between the light emission area farthest from the second light emission area among the light emission areas emitting light when the second electron-emitting device is driven and the second light emission area; and the driving circuit has a correction circuit;

wherein the correction circuit has:

a first circuit for calculating correction values for correcting the driving signals;

a second circuit for calculating a representative value by using a plurality of correction values for correcting the driving signal for driving each electron-emitting device of a group consisted of near M pieces of electron-emitting devices (M is an integer number of 2 or more and N or less) including first and second electron-emitting devices;

a storage unit for storing the representative value; and a third circuit for correcting the driving signals for driving each electron-emitting device of the group by using the representative value;

wherein a correction value for correcting the first driving signal is a correction value, which can compensate a brightness of the first light emission area generated when the first electron-emitting device is not driven but the third electron-emitting device is driven; and a correction value for correcting the second driving signal is a correction value, which can compensate a brightness of the second light emission area generated when the second electron-emitting device is not driven but the fourth electron-emitting device is driven.

6. The image display apparatus according to claim 5, wherein the image display apparatus has a spacer; and a first electron-emitting device and a second electron-emitting device are located at the same side with respect to the spacer.

7. The image display apparatus according to claim 6, wherein the spacer is a platy spacer; and the first and second electron-emitting devices are arranged in a parallel direction with the spacer.

8. The image display apparatus according to claim 5, wherein the image display apparatus has a spacer; and a distance between the first electron-emitting device and the spacer is equal to a distance between the second electron-emitting device and the spacer.

9. The image display apparatus according to claim 5, wherein the correction circuit has a selection unit; and the selection unit selects a driving signal which is corrected for driving each electron-emitting device of the group by using the representative value or a driving signal corrected for driving each electron-emitting device of the group by using a value having the smaller data amount than that of the correction value.

* * * * *

UNITED STATES PATENT AND TRADEMARK OFFICE

CERTIFICATE OF CORRECTION

PATENT NO. : 7,298,094 B2
APPLICATION NO. : 11/645055
DATED : November 20, 2007
INVENTOR(S) : Hideaki Yui It is certified that error appears in the above-identified patent and that said Letters Patent is hereby corrected as shown below:

COLUMN 2:

Line 22, “comprises:” should read --that comprises:--.

COLUMN 3:

Line 61, “multi electron” should read --multi-electron--; and
Line 66, “opposed” should read --opposed to--.

COLUMN 13:

Line 36, “above-describe” should read --above-described--; and
Line 37, “pursuit” should read --pursue--.

COLUMN 15:

Line 52, “part)” should read --part).--.

COLUMN 16:

Line 61, “(one bit)” should read --(one bit).--.

COLUMN 17:

Line 58, “spacer” should read --spacer:--; and
Line 67, “spacer” should read --spacer:--.

UNITED STATES PATENT AND TRADEMARK OFFICE

CERTIFICATE OF CORRECTION

PATENT NO. : 7,298,094 B2
APPLICATION NO. : 11/645055
DATED : November 20, 2007
INVENTOR(S) : Hideaki Yui It is certified that error appears in the above-identified patent and that said Letters Patent is hereby corrected as shown below:

COLUMN 18:

Line 18, "the" should be deleted.

COLUMN 19:

Line 11, "consisted" should read --consisting--.

Signed and Sealed this

Twenty-eighth Day of October, 2008

JON W. DUDAS
*Director of the United States Patent and Trademark Office*